United States Patent [19]

Stuckey

[11] 4,405,129

[45] Sep. 20, 1983

[54] THERAPEUTIC EXERCISE DEVICE

[76] Inventor: Joan Stuckey, 166 Burns Rd., Turramurra, Sydney, New South Wales, Australia, 2074

[21] Appl. No.: 253,394

[22] Filed: Apr. 13, 1981

[30] Foreign Application Priority Data

| | | | |
|---|---|---|---|
| Apr. 17, 1980 | [AU] | Australia | PE 3165 |
| Nov. 18, 1980 | [AU] | Australia | PE 6527 |
| Feb. 4, 1981 | [AU] | Australia | PE 7472 |

[51] Int. Cl.[3] ..... A63B 23/04

[52] U.S. Cl. ..... 272/130; 5/441; 5/449; 272/96

[58] Field of Search ..... 272/70, 96, 130; 5/338, 5/441, 442, 449, 455; 128/25 B, 64, 62 R

[56] References Cited

U.S. PATENT DOCUMENTS

| | | | |
|---|---|---|---|
| 1,371,919 | 3/1921 | Mahony | 5/455 |
| 1,795,304 | 3/1931 | Howard | 272/130 |
| 2,612,645 | 10/1952 | Boland | 5/341 |
| 3,298,044 | 1/1967 | Saltness et al. | 5/455 X |
| 3,644,949 | 2/1972 | Diamond | 5/441 |
| 3,658,326 | 4/1972 | Fawick | 272/68 |
| 3,785,642 | 1/1974 | Sterlicchi | 272/70 |
| 3,987,506 | 10/1976 | Markwitz | 5/441 |
| 4,146,222 | 3/1979 | Hribar | 272/70 |
| 4,300,759 | 11/1981 | Caplan | 272/130 |

FOREIGN PATENT DOCUMENTS

| | | | |
|---|---|---|---|
| 2261989 | 6/1974 | Fed. Rep. of Germany | 272/130 |
| 958651 | 5/1964 | United Kingdom . | |
| 1432259 | 4/1976 | United Kingdom . | |
| 1541170 | 2/1979 | United Kingdom . | |
| 2026315 | 2/1980 | United Kingdom . | |
| 2031742 | 4/1980 | United Kingdom . | |

*Primary Examiner*—Richard J. Johnson
*Attorney, Agent, or Firm*—Holman & Stern

[57] ABSTRACT

The present invention relates to a therapeutic exercise device comprising at least one closed container formed from flexible, substantially inextensible sheet material, said container being shaped to permit compression of same by two portions of a human body and being filled with fluid to partially pressurize the interior of said container, the pressure within said container being less than that required to make the container rigid, said container being formed into at least two compartments, each of said compartments being in direct fluid communication with at least one other of said compartments via at least one passage to inhibit the flow of fluid between said compartments in response to an external force applied to at least one of said compartments by movement of one of said human body portions to reduce the volume of said one compartment whereby the remainder of said compartments expand in volume thereby exerting a movement inducing force on the other one of said human body portions.

9 Claims, 9 Drawing Figures

47
471
43
-452-
46
42
IVa
-451-
421
-442-
-441-

471
42
472
-452-
-451-
-48-
-442-
41
-441-
412
411
413

51
57
59
-55-
-54-
56
532
531
52
Va 51
52
57
59
591
531
-54-

THERAPEUTIC EXERCISE DEVICE

BACKGROUND OF THE INVENTION

1. Field of the Invention

The present invention relates to an exercise device. The exercise device of the invention is especially suitable in the prevention of venous thrombosis in persons confined to a particular stance or position for considerable periods of time, e.g. in wheelchairs, in bed or during prolonged travel. The exercise device of the invention also finds use in the physiotherapy of patients recovering from illness or surgery.

2. Description of the Prior Art

R. E. C. Collins, S. Field and W. Castleden, B.M.J. 2, 1478 (1979) have reported that venous thrombosis and subsequent pulmonary embolism occurs after prolonged sedentary travel. Such thrombosis can be avoided if normal blood-flow is maintained. Normal blood-flow can be maintained by exercise. There is therefore a need for an inexpensive, simple, quiet, soft, pliable, lightweight, portable and hygienic exercise device which can be used during periods of prolonged travel. Such a device is provided by the present invention.

In addition to prolonged sedentary travel, similar problems are likely to occur also in geriatrics and persons occupied in sedentary trades or professions. The exercise device of the invention finds use in these applications.

In post-operative and ill patients undergoing bed rest, bed sores and potential thrombosis are problems. The exercise device of the invention is also useful in providing gentle but effective exercise for such patients and in avoiding and/or alleviating such problems.

SUMMARY OF THE INVENTION

The present invention provides a therapeutic exercise device comprising a closed container formed from flexible, substantially inextensible sheet material, said container being shaped to permit compression of same by two portions of a human body and being filled with fluid to partially pressurise the interior of said container, the pressure within said container being less than that required to make said container rigid, said container being formed into at least two compartments, each of said compartments being in direct fluid communication with at least one other of said compartments via at least one passage to inhibit the flow of fluid between said compartments in response to an external force applied to at least one of said compartments by movement of one of said human body portions to reduce the volume of said one compartment whereby the remainder of said compartments expand in volume thereby exerting a movement inducing force on the other one of said human body portions.

It is preferred that the exercise device be provided with a valve whereby it may be partially inflated with or emptied of the preferred fluid, air.

A first preferred embodiment of the invention, which is especially useful to persons engaged in prolonged sedentary travel, is manufactured from two sheets of material joined together to form two compartments, one of which is provided with a valve, and each compartment being in direct fluid communication with the other. It is preferred that the exercise device be of such size that, when deflated, it may be folded to approximately the size of a man's handkerchief.

In use, this embodiment is semi-inflated, and placed under the feet of a seated traveller or other user. Pressure with one foot on one compartment transfers air to the other compartment thereby raising the foot thereon. A pedalling or jogging on the spot movement is thus obtainable. All joints from toes to ankle, and knee to hip experience movement and alteration of position. Thighs are raised naturally and easily from contact with the seat. It has been found that once movement on the device is commenced subconscious movement continues, which makes the device especially useful in the case of geriatrics. The use may readily alter the inclination of either foot and hence change the angle between foot and leg.

It has been found in the case of one patient who had a tendon transplant on one ankle that use of the exercise device of the invention enabled the patient to get some hip extension and foot plantarflexion which movements were desirable post-operation.

Preliminary tests into the effect of this first preferred embodiment of the invention on vascular circulation have been conducted using the Doppler ultra-sound technique. The tests have indicated that circulation increased 7% after 5 minutes exercise by heel-toe action on the exercise device. This indicates that 5 minutes use of the exercise device of the invention approximates to a walk of 200 m.

Whilst the first preferred embodiment is described above in relation to use under the feet of a seated user, its use is not restricted thereto. It may be used, with corresponding alteration of size if necessary, under any parts of the body whether the user is in a seated or lying position, e.g. under the calves, thighs, buttocks, lumbar region, shoulders or neck. It also finds use in exercising the hands and fingers where one compartment is held in each hand and air squeezed to and fro between the compartments.

A second preferred embodiment of the invention, which is especially useful to patients recovering from illness or surgery, has four compartments arranged side by side in line and is preferably, for hygienic reasons, made of suitable size to fit in a standard pillow case.

In use, this embodiment is partially inflated and placed under the heels, calves or thighs of a patient in bed. Pressure with one heel, calf or thigh on one compartment transfers air to the other compartments including that one under the other heel, calf or thigh, which is accordingly raised. A pedalling movement is thus obtained.

The degree of inflation in this embodiment is preferably 75% to ensure that some of the air displayed by pressure on one compartment by a heel, calf or thigh reaches the compartment under the other heel, calf or thigh.

Most preferably in this embodiment the divisions between the compartments in this embodiment are non-linear. When used under calves or thighs, the legs are thus prevented from slipping into the divisions.

This embodiment has been found useful in the prevention of the onset of venous thrombosis in the lower legs and pressure injury, which are frequent complications of immobility and bed-rest.

A further integer applicable to all embodiments of the invention comprises adjustment means adapted to adjust the height of the plane in which the compartments in direct fluid communication with each other are located. The adjustment means is preferably a further inflatable undercompartment which, as well as permitting height adjustment, provides insulation against transferred impact.

A third embodiment of the invention relates to a plurality of exercise devices of the invention, said exercise devices being attached in linear spaced relationship to enable two or more parts of the body to be exercised at the same time. For example: two of the above described first preferred embodiments may be joined by non-inflatable plastics sections, or by straps, so that a traveller could exercise with one device under the feet and another under the thighs; or two of the above described second preferred embodiments could be joined likewise to enable both the calves or thighs of a bed-rest patient to be raised from the mattress and exercised.

In a preferred form of the third embodiment of the invention, a triple exercise device is formed from three of the above described first preferred embodiments which are provided aligned with their transverse ends parallel and joined by spacers such that they may be placed under the thighs, lumbar region and neck of a user in the seated or prone position. The spacers are preferably adjustable so that the triple exerciser can be used by persons of various heights. Adjustment may be achieved by folding of the spacers are formed by non-inflatable plastics sections or by buttons, buckles, Velcro (Registered Trade Mark) fastening and the like, if the spacers are straps. Buttons, buckles, Velcro fastening and the like may also be used in conjunction with the non-inflatable plastics sections.

BRIEF DESCRIPTION OF THE DRAWINGS

Preferred embodiments of the invention will now be described with reference to the drawings in which FIG. 1 respresents an exercise device of the invention especially useful for a user in the seated position.

This embodiment is designed to be used primarily by persons in the sitting position for the leg exercise. The user places both feet on the device, one foot on each compartment, and by exerting pressure with one foot causes fluid to flow from the compartment under that foot into the other compartment thereby exerting a lifting force on the other foot. Pressure is applied sequentially by each foot thereby exercising the legs.

Figure 1:
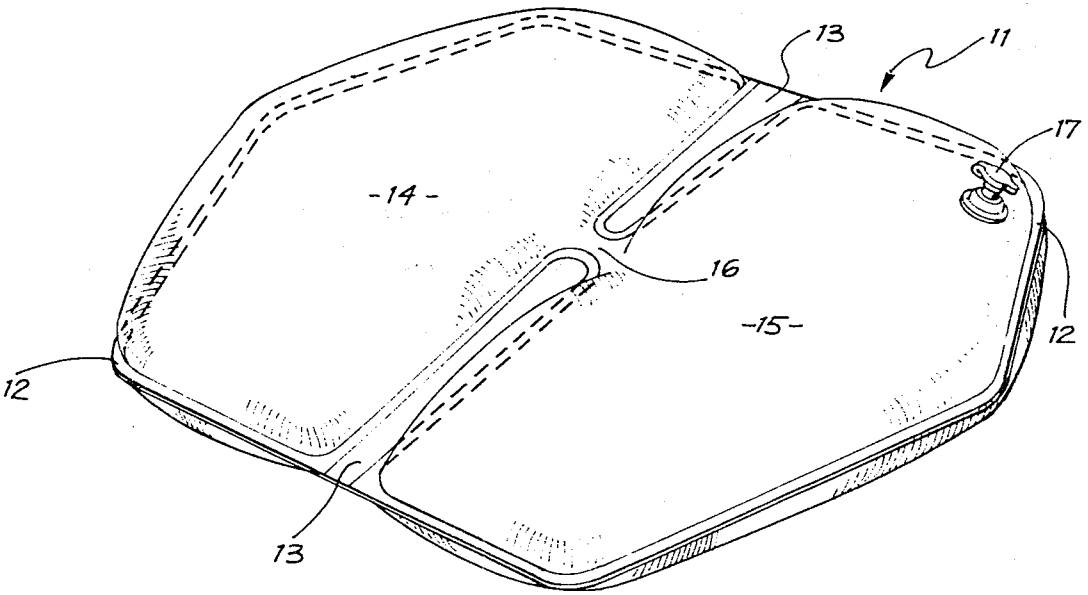
In FIG. 1, the exercise device 11, shown in its semi-inflated condition is fabricated from two sheets of plastics material joined by welds 12 around the perimeter and which continue inwards forming divisions 13 dividing the device 11 into a left compartment 14 and a right compartment 15 in direct communication with each other via passage 16. The right compartment 16 is provided with valve 17 by which the the device 11 is filled with or emptied of fluid which is preferably air.
Figure 2:
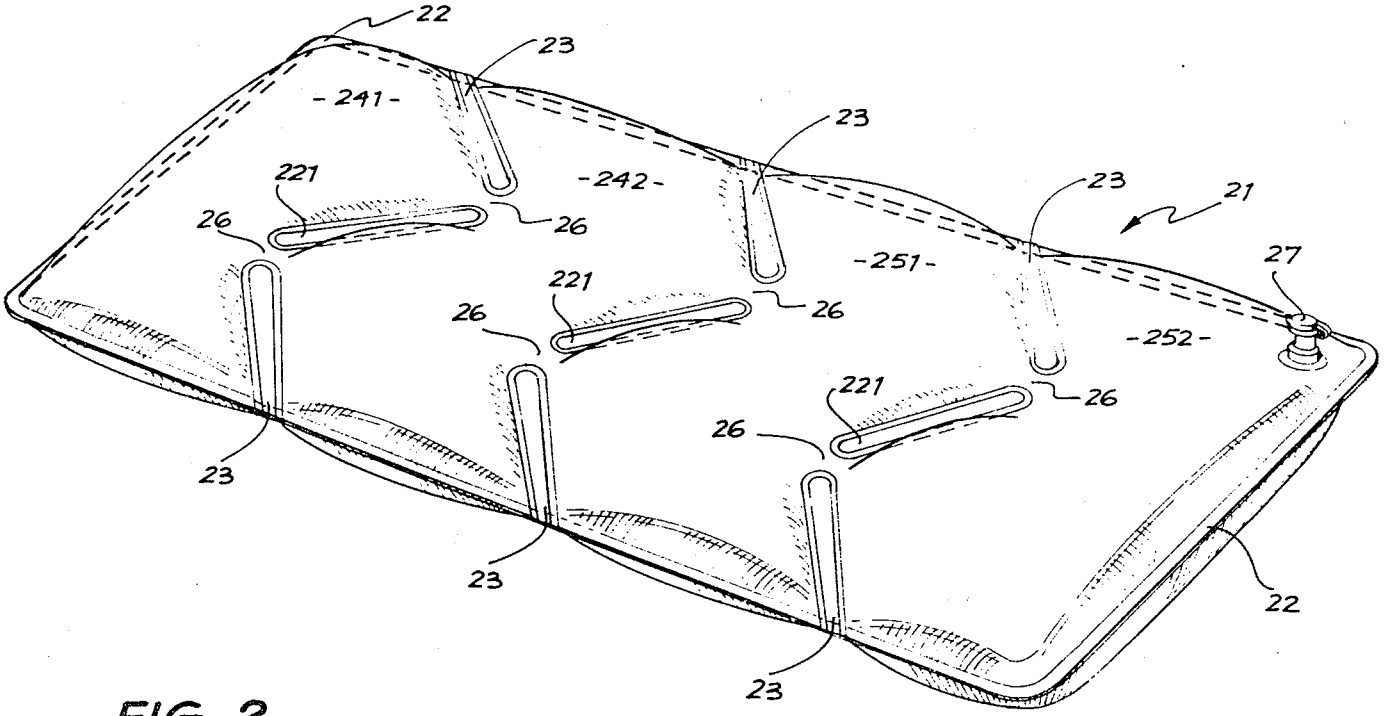
FIG. 2 represents an exercise device of the invention especially useful for a user in the lying position.

In FIG. 2 the exercise device 21 is also shown in its semi inflated condition and is fabricated in like manner to the embodiment illustrated in FIG. 1, with welds 22 around the perimeter continuing inwards to form divisions or partitions 23. Internal partitions or welds 221 together with divisions 23 define the compartments 241, 242, 251 and 252 each of which is in direct communication with each of its neighbours via passages 26. Compartment 252 is provided with a valve 27. The interior limits of the compartments 241, 242, 251 and 252 formed by divisions 23 and internal welds 221 define non-linear boundaries in this preferred embodiment of the invention.

This embodiment is designed to be used primarily be persons in the lying positions, especially by patients confined to bed. It may be manufactured conveniently in a suitable size to fit inside a standard-pillow case. The device is placed under the patients heels, calves or thighs with the legs resting on any two compartments. The non-linear boundaries prevent the user's legs slipping into the depressions between the compartments. The legs are exercised in similar manner as described hereinabove in relation to FIG. 1.

Figure 3:
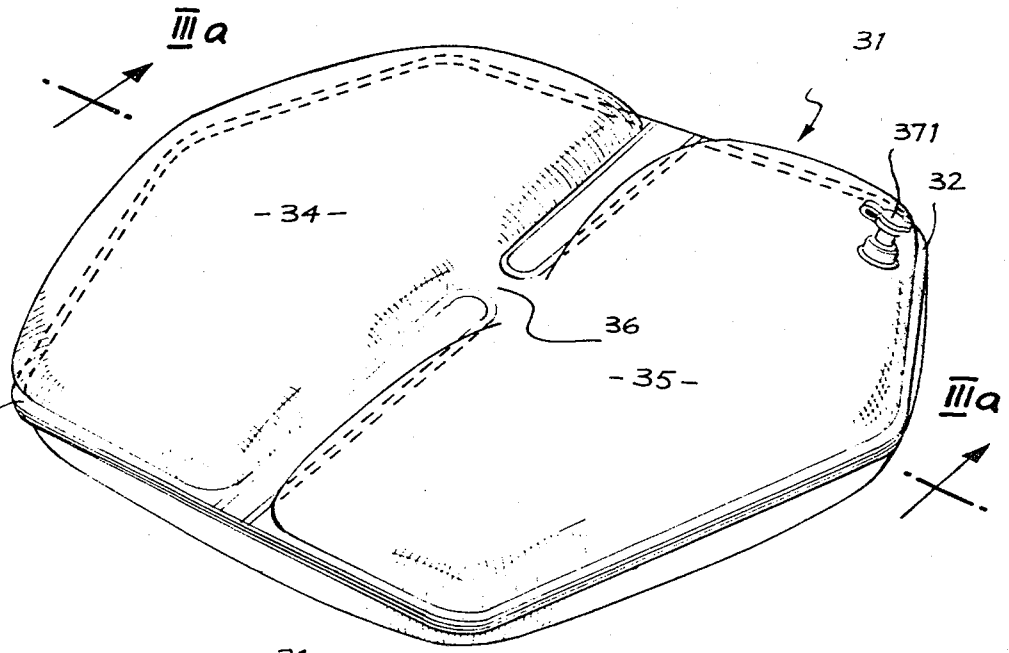
FIG. 3 represents a modification of the embodiment depicted in FIG. 1.
Figure 3A:
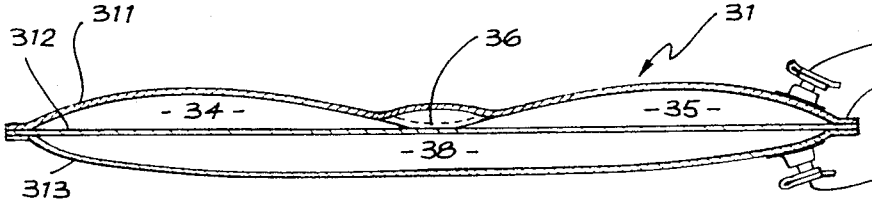
FIG. 3*a* represents a section through the line IIIa—IIIa of FIG. 3.

FIGS. 3 and 3*a* depict a variation of the embodiment illustrated in FIG. 1 where means to elevate and lower the exercise device are provided. The exercise device 31 is formed from three sheets of plastics material, an upper sheet 311, a middle sheet 312 and a lower sheet 313. Divisions 33 are formed by welding sheets 311 and 312 together, and the device 31 completed by joining sheets 311, 312 and 313 by perimeter welds 32. The exercise device 31 is thus divided into a left compartment 34, a right compartment 35 and a lower compartment 38, the left compartment 34 and right compartment being in direct communication with each other via passage 36. The right compartment the lower compartment 38 are provided with valves 371 and 372 respectively.

This embodiment is used in exactly the same manner as the embodiment depected in FIG. 1 and has the additional feature that it may be adjusted to take into account different physical dimensions of various users. Lower compartment 38 can be fully inflated when the device is being used by shorter persons and uninflated or partially inflated for taller persons.

Figure 4:
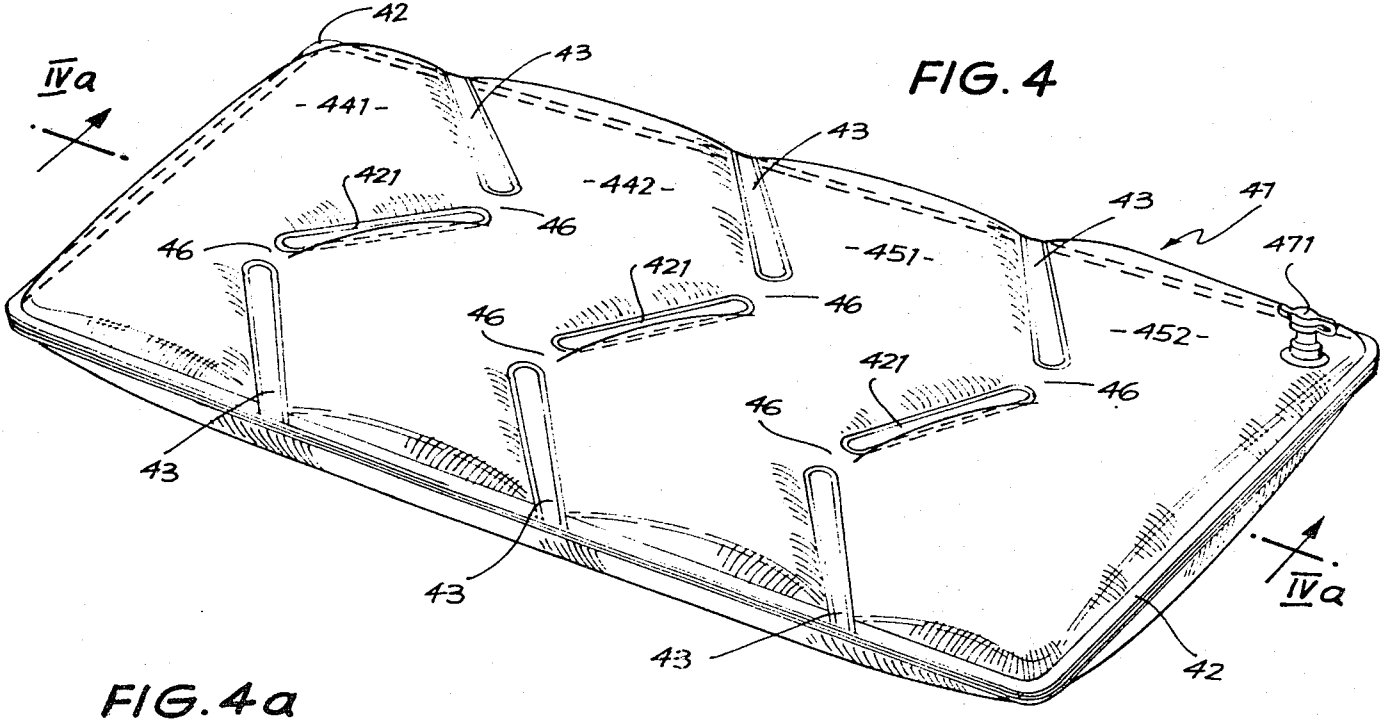
FIG. 4 represents a modification of the embodiment depected in FIG. 2.
Figure 4A:
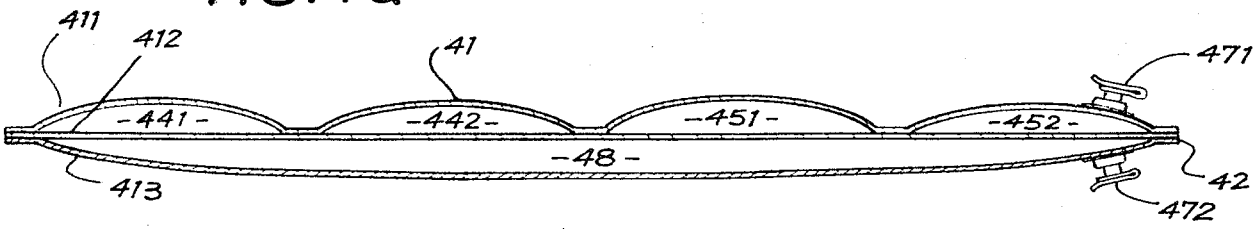
FIG. 4*a* represents a section through the line IVa—IVa of FIG. 4.

The exercise device 41 of FIGS. 4 and 4*a* embodies features of the devices of FIGS. 2 and 3. It is depicted with compartments 441, 442, 451 and 452 in semi-inflated condition and in direct communication with their direct neighbours via passages 46. Lower compartment 48 is shown in FIG. 4*a* in a fully inflated condition. In like manner to the embodiment of FIG. 2, compartments 441, 442, 451 and 452 are separated by non-linear boundaries defined by divisions 43 and internal welds 421 between upper sheet 411 and middle sheet 412 with perimeter welds 42 joining sheets 411 and 412 to a lower sheet 413 thereby forming lower compartment 48. Compartments 452 and 48 are provided with valves 471 and 472 respectively.

This embodiment may be used in like manner to the embodiment of FIG. 2, compartment being uninflated or inflated to a greater or lesser degree to raise or lower the legs of the user under which the exercise device 41 is placed.

Figure 5:
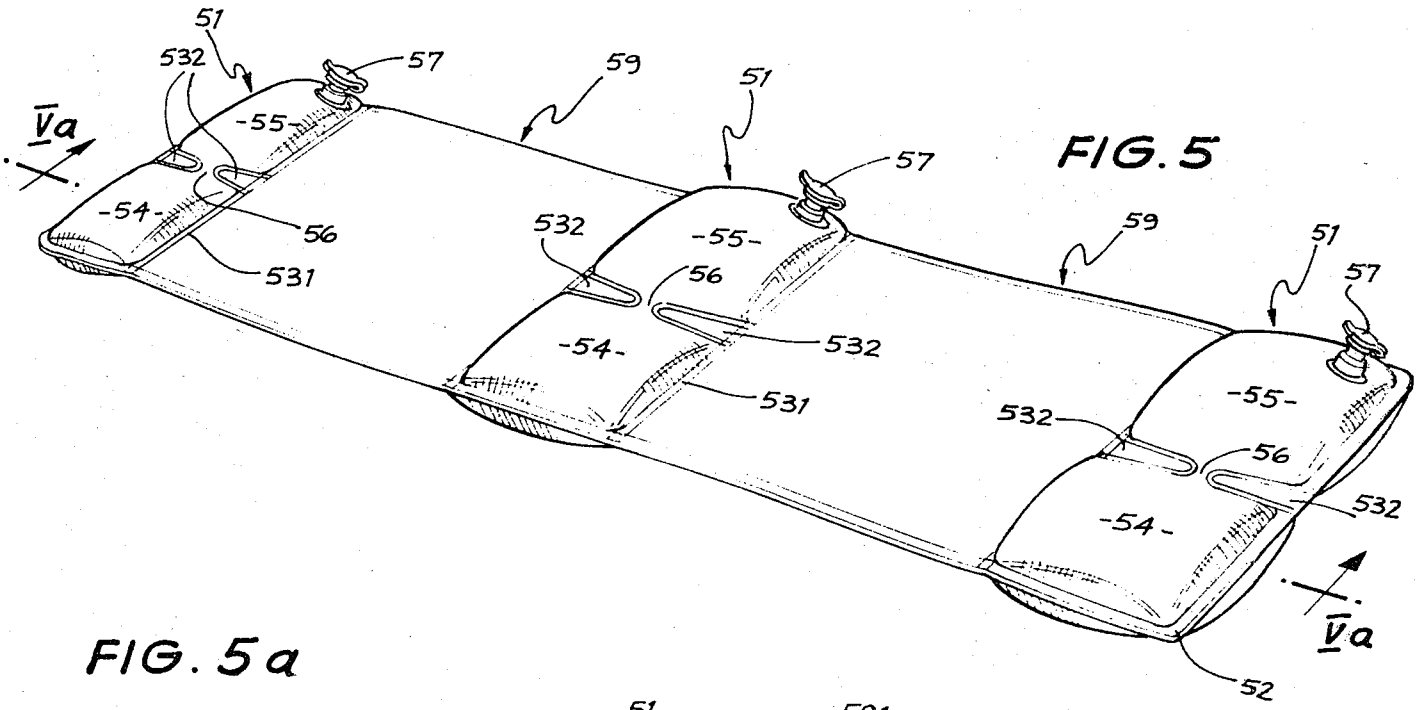
FIG. 5 represents a modification of the exercise device depicted in FIG. 1 allowing a user to exercise more than one portion of the body.
Figure 5A:
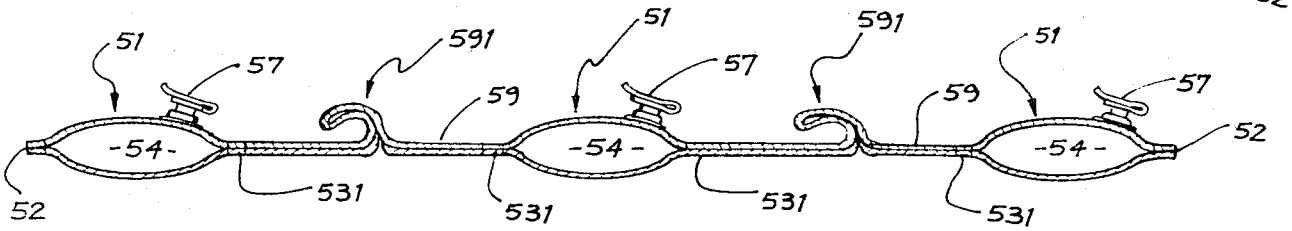
FIG. 5*a* represents a section through the line Va—Va of FIG. 5.

FIGS. 5 and 5*a* shows a composite exercise device consisting of three exercises 51 each shown in semi-inflated condition and separated by spacers 59. This embodiment is fabricated from two sheets of plastics material joined by welds 52 which also form divisions 531 which divide the composite exercise device into exercisers 51 and spacers 59, and divisions 532 which divide exercisers 51 into left compartments 53 and right compartments 55 each pair of which are in direct communication with each other via passages 56. Each right compartment is provided with a valve 57 by which each exerciser 51 may be filled or emptied. As shown in FIG. 5*a*, spacers 59 may be shortened by folding as illustrated at 591.

This embodiment enables a user to exercise three parts of the body, e.g., the neck, the small of the back, and the thighs, at the same time, in either the sitting or lying position.

The embodiment shown in FIGS. 5 and 5*a* may also be formed by welding three short lengths of plastics material to a single long length of plastics material at the appropriate positions to form the three exercisers.

Figure 6:
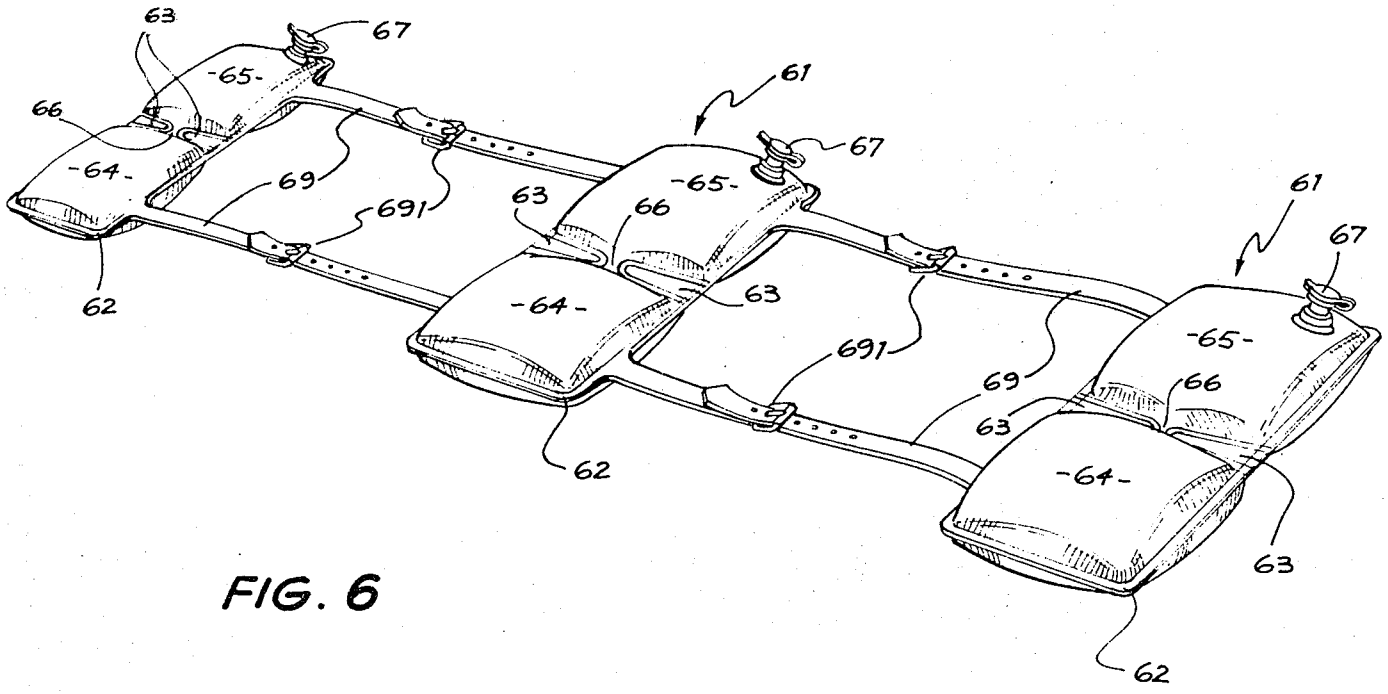
FIG. 6 represents a modification of the embodiment depicted in FIG. 5.

In FIG. 6, the composite exercise device consists of three exercisers 61 each shown in semi-inflated condition. The exercisers are substantially identical to that described in FIG. 1, each comprising left compartments 64 and right compartment 65 in direct communication with each other via passage 66 defined by divisions 63, the exercisers 61 being formed from two sheets of plastics material secured by welds 62. Each right compartment is illustrated with a valve 67. Instead of the foldable spacers 59 of the embodiment shown in FIG. 5, the exercisers 61 are separated by straps 69 which are adjustable by buckles 691.

To be useful for exercise purposes, it is important that there be sufficient inhibition to flow of fluid between compartments of the exercise devices of the invention that fluid in one compartment is not immediately displaced by placing one body portion on that compartment with little or no force being applied.

It has been found that the average force applied by the foot of a seated healthy human adult on one compartment of the embodiment depicted in FIG. 1 is about 70 N±30 N. A convenient size for use by travellers of the embodiment of FIG. 1 is such that when semi-inflated with fluid, it contains 2.0 L±0.2 L. On such an exercise device, it has been determined that with the device 11 resting on a surface under the feet of a seated average healthy adult, left foot on left compartment 14 and right foot on right compartment 15, the left foot fully depressed, application of an average force by the right foot to effect a single stroke of exercise will fully depress the right foot in 0.5s to 0.7s, thereby displacing 0.7 L±0.1 L (about 30% of the total volume of fluid) to the left compartment 14 when the perimeter of the cross-section of the passage 16 is about 38 mm.

In the embodiment of FIG. 2, two passages 26 are shown between each pair of adjacent compartments 241 and 242, 242 and 251, and 251 and 252. This embodiment is primarily intended for use by patients recovering from surgery or illness who are usually not able to apply as great a force to the exercise device as a healthy adult. Accordingly, it has been found that when the perimeters of the cross-sections of passages 26 are also about 38 mm, a single stroke of exercise can be achieved in 0.4s to 0.8s.

It should be emphasised that this does not mean that exercise on the embodiments as described immediately above is restricted to a stroking rate of 0.4s to 0.8s, this will be, however, the average maximum rate of exercise achievable on those embodiments by the average users thereof.

It is therefore preferred that, in the exercise devices according to the invention, the total area of cross section of the passage or passages between adjacent compartments is such that, on application of an average force on a first compartment by a first body portion, the time taken to displace sufficient fluid from said first compartment to achieve a stroke of exercise is between 0.4s and 0.8s. It should be emphasised, however, that the invention is not restricted to exercise devices having such an area of cross-section of passage or passages between adjacent compartments. The exercise device of the invention, may also find use in the training of athletes or by persons wishing to improve their fitness, in which cases a passage of smaller cross-sections would be desirable to require a greater force to be applied for more strenuous exercise.

What I claim is:

1. A theraputic exercise device comprising two closed containers formed from flexible, substantially inextensible sheet material and having substantially the same shape, said containers being located one above the other with no fluid communication between said two containers; the upper one of said two containers being shaped to permit compression of same by at least two portions of a human body, being filled with fluid to partially pressurise the interior of said upper container with the pressure therein being less than that required to make said upper container rigid; said upper container being formed into at least two compartments by partions; and each of said compartments being in direct fluid communication with at least one other of said compartments via at least one passage to restrict the flow of fluid between said compartments in response to an external force applied to at least one of said compartments by movement of one of said human body portions to reduce the volume of said one compartment, whereby the remainder of said compartments expand in volume thereby exerting a movement inducing force on the other ones of said human body portions.

2. The device as defined in claim 1 wherein said upper container includes a valve means for introducing fluid into, and removing fluid from, said upper container.

3. The device as defined in claim 1 wherein the lower one of said containers includes a valve means for introducing fluid into, or removing fluid from, said lower container, height adjustment of said upper container being achieved by introducing fluid into, and removing fluid from, said lower container.

4. The device as defined in any one of claims 1 to 3 wherein said fluid is air.

5. The device as defined in claim 1 wherein said upper container has two compartments formed by a single partition, said one passage comprising an opening through said partition.

6. The device as defined in claim 1 wherein said upper container is formed into four compartments, which compartments are arranged in tandem, each of said compartments being separated from the next adjacent compartments by one of said partitions.

7. The device as defined in claim 6 wherein said partitions are non-linear and each of said partitions includes two of said passages.

8. The device as claimed in any one of claims 1, 5 or 6 wherein the cross-sectional area of each passage is determined by the uninterrupted extent of the corresponding partition and restricts the flow of fluid between adjacent compartments whereby the time taken to transfer sufficient fluid between said adjacent compartments is from 0.4 seconds to 0.8 seconds.

9. The device as defined in any one of claims 1, 5 or 6 wherein said lower container comprises a single compartment.

* * * * *